US007380316B1

(12) United States Patent
Sauder et al.

(10) Patent No.: US 7,380,316 B1
(45) Date of Patent: Jun. 3, 2008

(54) CASKET LID ASSEMBLY

(75) Inventors: Myrl D. Sauder, Archbold, OH (US); Steve S. Robison, West Unity, OH (US)

(73) Assignee: Sauder Woodworking Co., Archbold, OH (US)

( * ) Notice: Subject to any disclaimer, the term of this patent is extended or adjusted under 35 U.S.C. 154(b) by 0 days.

(21) Appl. No.: 11/879,461

(22) Filed: Jul. 17, 2007

(51) Int. Cl.
*A61G 17/00* (2006.01)

(52) U.S. Cl. ..... 27/14

(58) Field of Classification Search ..... 27/2, 27/14, 16, 17; D99/12
See application file for complete search history.

(56) References Cited

U.S. PATENT DOCUMENTS

| | | | |
|---|---|---|---|
| 1,610,781 | A | 12/1926 | Hollins |
| 3,491,114 | A | 1/1970 | Connelly |
| 3,835,509 | A | 9/1974 | Esterdahl |
| 3,879,818 | A | 4/1975 | Rowland |
| 3,924,309 | A | 12/1975 | Andrus, Jr. et al. |
| 3,962,761 | A | 6/1976 | Boughner |
| 4,930,197 | A | 6/1990 | McClive |
| 5,499,886 | A | 3/1996 | Short et al. |
| 5,570,493 | A | 11/1996 | Gulick |
| 5,611,124 | A | 3/1997 | Biondo et al. |
| 5,632,073 | A | 5/1997 | Foye |
| D388,225 | S | 12/1997 | Saaf et al. |
| 5,709,016 | A | 1/1998 | Gulick et al. |
| 5,727,291 | A | 3/1998 | Biondo et al. |
| 5,765,268 | A | 6/1998 | MacKirdy |
| D405,932 | S | 2/1999 | Winburn |
| D407,181 | S | 3/1999 | Winburn |
| 5,974,640 | A | 11/1999 | Vosahlik et al. |
| 5,985,399 | A | 11/1999 | Tambussi |
| 6,018,853 | A | 2/2000 | Chen et al. |
| 6,094,789 | A | 8/2000 | Hankel et al. |
| 6,138,334 | A | 10/2000 | Tambussi |
| 6,145,175 | A | 11/2000 | Enneking et al. |
| 6,151,762 | A | 11/2000 | Cox |
| 6,179,515 | B1 | 1/2001 | Grieser et al. |
| 6,237,202 | B1 | 5/2001 | Agee et al. |
| 6,238,327 | B1 | 5/2001 | Tambussi |
| 6,243,931 | B1 | 6/2001 | Linville et al. |
| 6,301,758 | B1 | 10/2001 | Biondo et al. |
| 6,317,942 | B1 | 11/2001 | Hankel et al. |
| 6,446,315 | B2 | 9/2002 | Agee et al. |
| 6,503,429 | B1 | 1/2003 | Linville et al. |
| 6,574,841 | B1 | 6/2003 | Vosahlik et al. |
| 6,715,190 | B2 | 4/2004 | Groemminger et al. |
| 6,722,001 | B2 | 4/2004 | Baker |
| 6,735,831 | B1 | 5/2004 | Greiwe et al. |
| 6,742,231 | B1 | 6/2004 | Calhoun et al. |
| 6,745,442 | B2 | 6/2004 | Biondo et al. |
| 6,836,936 | B1 | 1/2005 | Biondo et al. |

(Continued)

*Primary Examiner*—William L. Miller
(74) *Attorney, Agent, or Firm*—MacMillan, Sobanski & Todd, LLC

(57) ABSTRACT

A lid assembly for a casket has an end rail including an end rail notch. Opposing side rails are attached to the end rail. The side rails each include a side rail notch. An end section is positioned within the end rail notch. A lid dome includes a pair of dome side edges. The lid dome is flexed to form a flexed lid dome. The dome side edges are positioned within the side rail notches and in contact with the end section. The lid dome and the end section form a lid joint.

18 Claims, 5 Drawing Sheets

U.S. PATENT DOCUMENTS 6,849,141 B2 2/2005 Buchler et al.
6,922,877 B2 8/2005 Linville et al.
6,976,294 B2 12/2005 Biondo et al.
7,069,627 B2 7/2006 Cunningham et al.
7,147,811 B2 12/2006 Linville
7,247,264 B2 7/2007 Buchler et al.
2001/0049868 A1 12/2001 Tambussi
2004/0200046 A1 10/2004 Biondo et al.
2005/0005410 A1 1/2005 Biondo et al.
2005/0028333 A1 2/2005 Vasahlik et al.

CASKET LID ASSEMBLY

TECHNICAL FIELD

The invention relates generally to caskets. More specifically, the invention is directed to a lid for a casket.

BACKGROUND OF THE INVENTION

Caskets are used for the interment of the bodies of deceased persons. Before interment, the body of the deceased is typically displayed for the benefit of loved ones at a funeral. When the body is displayed, the head portion of the casket lid and/or the leg portion of the casket lid is opened and locked in a raised position. When the viewing is completed, the lid portion(s) are returned to a closed position.

In the closed position, the lid portions provide space between the body of the deceased and the outer shell of the casket. The lid portions should be economical and easy to manufacture. The invention provides such a casket lid.

SUMMARY OF THE INVENTION

A lid assembly for a casket has an end rail including an end rail notch.

Opposing side rails are attached to the end rail. The side rails each include a side rail notch.

An end section is positioned within the end rail notch.

A lid dome includes a pair of dome side edges. The lid dome is flexed to form a flexed lid dome. The dome side edges are positioned within the side rail notches and in contact with the end section. The lid dome and the end section form a lid joint.

DETAILED DESCRIPTION OF THE INVENTION

Figure 1:
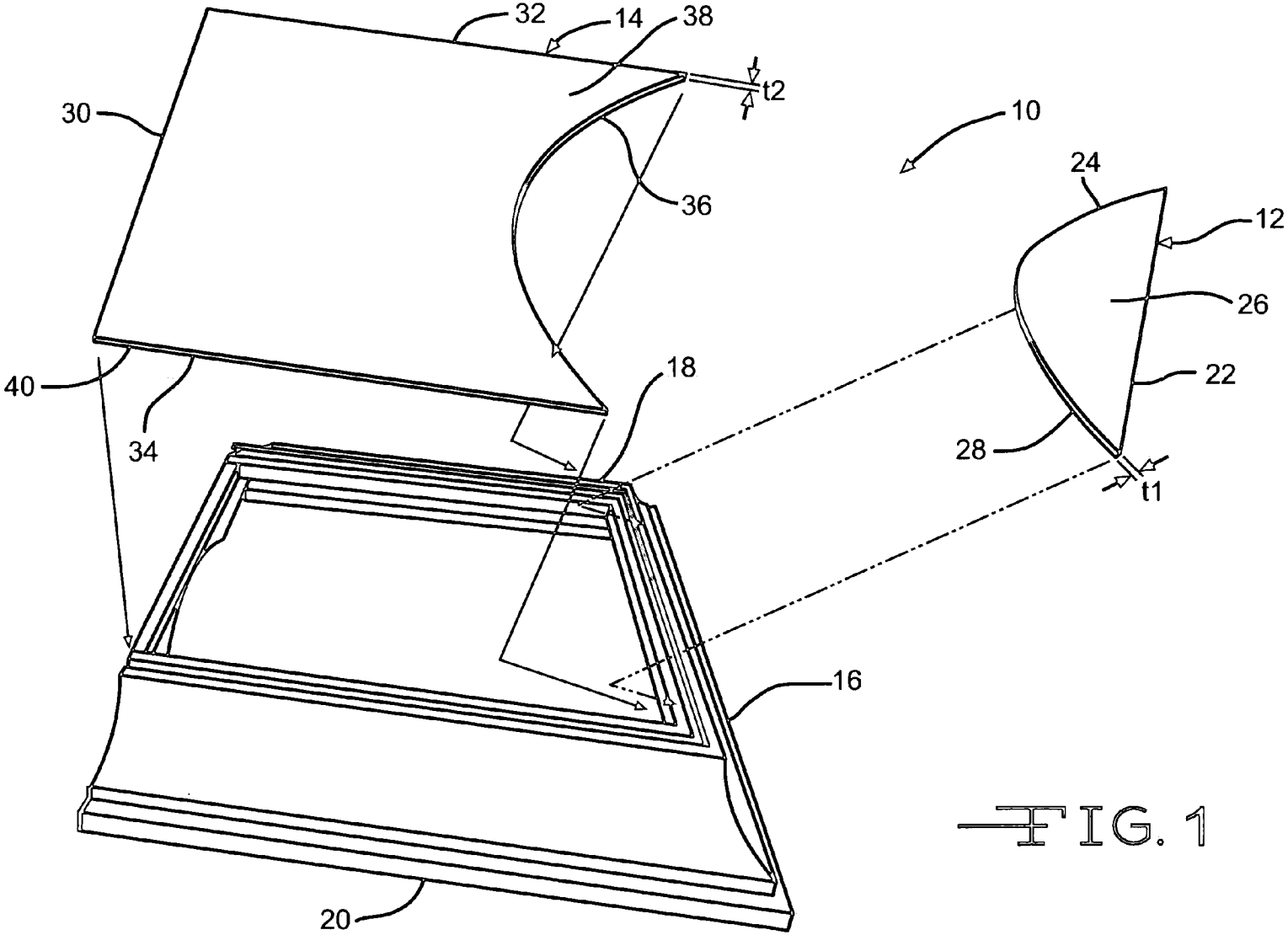
FIG. 1 is an exploded perspective view of a casket lid assembly of the invention.
Figure 2:
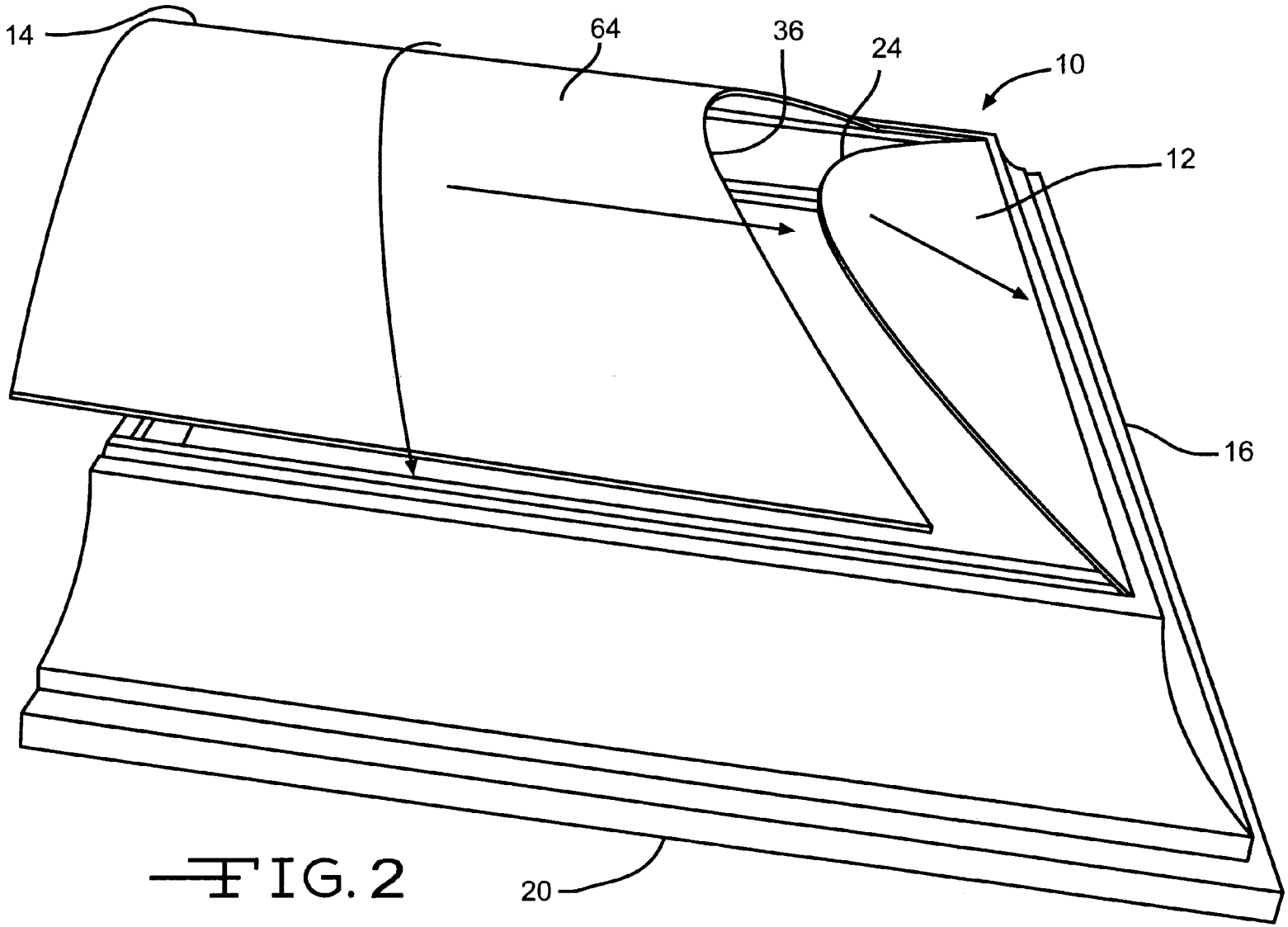
FIG. 2 is a perspective view of a partially assembled casket lid assembly thereof.

Referring to FIG. 1, a casket lid assembly 10 is shown having an end section 12, a lid dome 14, an end rail 16 and a pair of opposing side rails 18 and 20. The end section 12 includes a substantially straight edge 22, an end section arcuate edge 24, an outside surface 26 and an inside surface 28. As will be explained in detail below, the straight edge 22 is attached to the end rail 16 and to the lid dome 14. In the illustrated embodiment, the end section 12 is made of plywood having a thickness t1. In another embodiment, the end section 12 can be made of another material, such as for example hardboard or pressboard. In the illustrated embodiment, the thickness t1 is approximately 2.0-3.0 mm. In another embodiment, the thickness t1 can be more than 3.0 mm or less than 2.0 mm. In the illustrated embodiment, the outside surface 26 includes a wood veneer having a furniture quality finish. In another embodiment the outside surface 26 can be finished with another material or method, such as for example a laminate, sufficient to provide a desired appearance.

The lid dome 14 includes a dome end edge 30, opposing dome side edges, 32 and 34, a dome arcuate edge 36, a dome outside surface 38 and a dome inside surface 40. As will be explained in detail below, the opposing dome side edges 32 and 34 are attached to the opposing side rails 18 and 20 and the dome arcuate edge 36 attaches to the arcuate edge 24 of the end section 12. In the illustrated embodiment, the lid dome 14 is made of plywood having a thickness t2. In another embodiment, the end section 12 can be made of another material, such as for example hardboard or pressboard. In the illustrated embodiment, the thickness t2 is approximately 2.0-3.0 mm. In another embodiment, the thickness t2 can be more than 3.0 mm or less than 2.0 mm. In the illustrated embodiment, the outside surface 38 includes a wood veneer having a furniture quality finish. In another embodiment the outside surface 38 can be finished with another material or method, such as for example a laminate, sufficient to provide a desired appearance.

Figure 5:
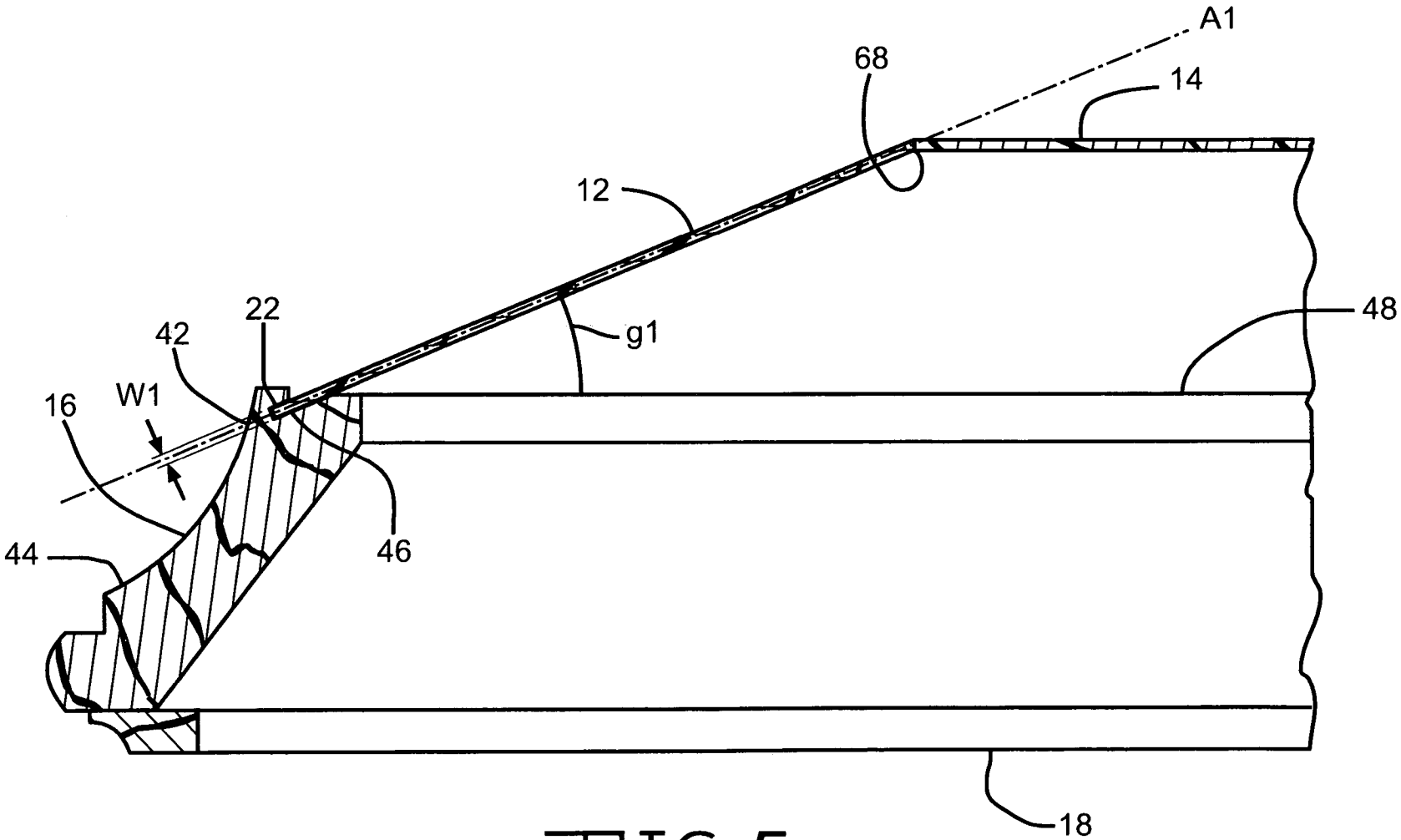
FIG. 5 is a cross left side cross-sectional view of an assembled casket lid assembly, taken along line 5-5 of FIG. 3.

As shown in FIG. 5, the end rail 16 is made of wood and has a furniture quality finish. In another embodiment, the end rail 16 can be made of another material, such as for example a polymer, and can have another finish, such as for example a painted finish. The end rail 16 includes an end rail top section 42 and an end rail bottom section 44. As shown in FIG. 5, the end rail top section 42 and the end rail bottom section 44 have various molding features adapted to provide a desired aesthetic appearance. In another embodiment, the end rail top section 42 and the end rail bottom section 44 can have any configuration of molding features sufficient to provide a desired aesthetic appearance.

The end rail top section 42 includes an end rail notch 46. The end rail notch 46 is adapted to receive the straight edge 22 of the end section 12. As shown in FIG. 5, the end rail notch 46 has a substantially rectangular cross-sectional shape. In another embodiment, the end rail notch 46 can have another cross-sectional shape. In the illustrated embodiment, the end rail notch 46 extends the length of the end rail 16. In another embodiment, the end rail notch 46 can extend less than the length of the end rail 16. As shown in FIG. 5, the end rail notch 46 has a width W1 corresponding to the thickness t1 of the end section 12. In another embodiment, the end rail notch 46 can have a width W1 that is less than or more than the thickness t1 of the end section 12. As further shown in FIG. 5, the end section 12 positioned within the end rail notch 46, is centered on axis A1. Axis A1 forms an angle g1 with a top 48 of the side rail 18. In the illustrated embodiment, the angle g1 is 22.5°. In another embodiment, the angle g1 can be more or less than 22.5°.

Figure 4:
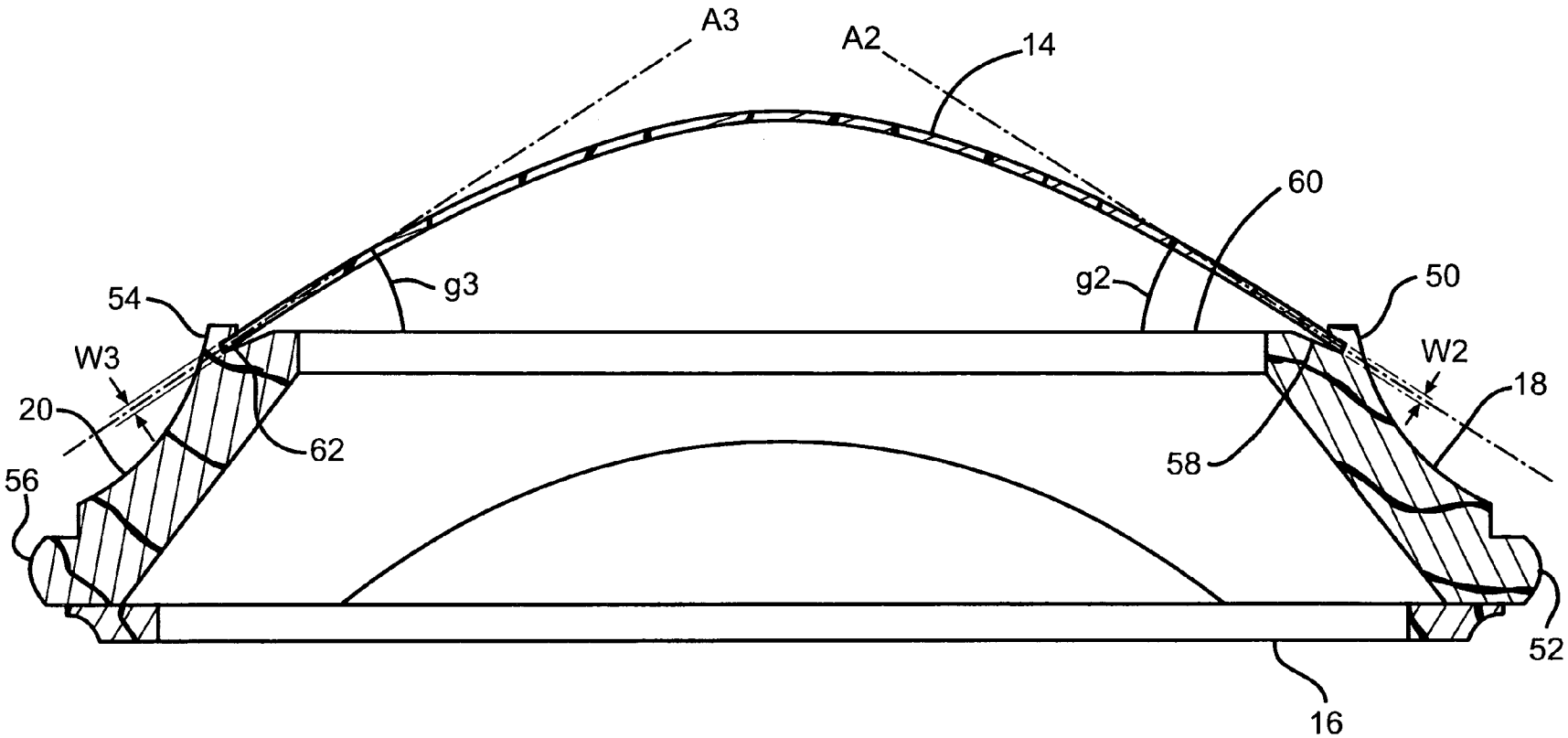
FIG. 4 is a left side cross-sectional view of an assembled casket lid assembly thereof, taken along the line 4-4 of FIG. 3.

As shown in FIG. 4, the side rails, 18 and 20, are made of wood and each has a furniture quality finish. In another embodiment, the side rails, 18 and 20, can be made of another material, such as for example a polymer, and can have another finish, such as for example a painted finish.

The side rail 18 includes a side rail top section 50 and a side rail bottom section 52. As shown in FIG. 4, the side rail top section 50 and the side rail bottom section 52 have various molding features adapted to provide a desired aesthetic appearance. In another embodiment, the side rail top section 50 and the side rail bottom section 52 can have any configuration of molding features sufficient to provide a desired aesthetic appearance.

The side rail top section 50 includes a side rail notch 58. The side rail notch 58 is adapted to receive the dome side edge 32 of the lid dome 14. As shown in FIG. 4, the side rail notch 58 has a substantially rectangular cross-sectional shape. In another embodiment, the side rail notch 58 can have another cross-sectional shape. In the illustrated embodiment, the side rail notch 58 extends the length of the side rail 18. In another embodiment, the side rail notch 58 can extend less than the length of the side rail 18. As shown in FIG. 4, the side rail notch 58 has a width W2 corresponding to the thickness t2 of the lid dome 14. In another embodiment, the side rail notch 58 can have a width W2 that is less than or more than the thickness t2 of the lid dome 14. As further shown in FIG. 4, the dome side edge 32 positioned within the side rail notch 58, is centered on axis A2. Axis A2 forms an angle g2 with a top 60 of the end rail 16. In the illustrated embodiment, the angle g2 is 22.5°. In another embodiment, the angle g2 can be more or less than 22.5°.

The side rail 20 includes a side rail top section 54 and a side rail bottom section 56. As shown in FIG. 4, the side rail top section 54 and the side rail bottom section 56 have various molding features adapted to provide a desired aesthetic appearance. In another embodiment, the side rail top section 54 and the side rail bottom section 56 can have any configuration of molding features sufficient to provide a desired aesthetic appearance.

The side rail top section 54 includes a side rail notch 62. The side rail notch 62 is adapted to receive the dome side edge 34 of the lid dome 14. As shown in FIG. 4, the side rail notch 62 has a substantially rectangular cross-sectional shape. In another embodiment, the side rail notch 62 can have another cross-sectional shape. In the illustrated embodiment, the side rail notch 62 extends the length of the side rail 20. In another embodiment, the side rail notch 62 can extend less than the length of the side rail 20. As shown in FIG. 4, the side rail notch 62 has a width W3 corresponding to the thickness t2 of the lid dome 14. In another embodiment, the side rail notch 62 can have a width W3 that is less than or more than the thickness t2 of the lid dome 14. As further shown in FIG. 4, the dome side edge 34 positioned within the side rail notch 62, is centered on axis A3. Axis A3 forms an angle g3 with a top 60 of the end rail 16. In the illustrated embodiment, the angle g3 is 22.5°. In another embodiment, the angle g3 can be more or less than 22.5°.

Figure 3:
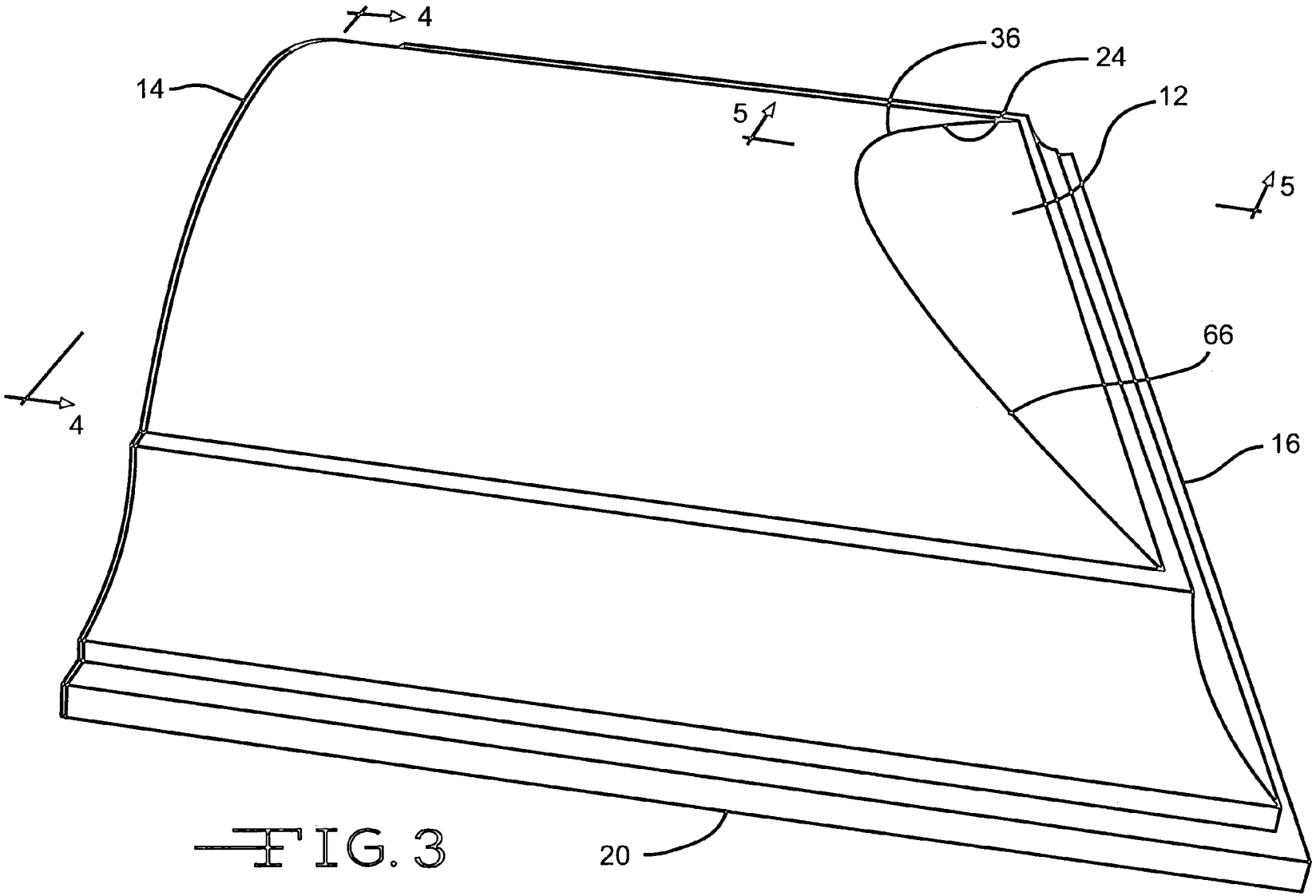
FIG. 3 is a perspective view of an assembled casket lid assembly thereof.

As shown in FIGS. 1-4, assembly of the casket lid assembly 10 includes attaching the end rail 16 to the opposing side rails, 18 and 20. The edge 22 of the end section 12 is positioned in the end rail notch 46 of the end rail 16. As previously discussed, the edge 22 positioned in the end rail notch 46 of the end rail 16 forms angle g1 with the top 48 of the side rail 18. As further shown in FIGS. 2 and 4, the lid dome 14 is flexed to form a flexed lid dome 64. The flexed lid dome 64 is adapted such that the dome side edges, 32 and 34, are positioned within the side rail notches, 58 and 62, respectively. The flexed lid dome 64 forms a dome shaped cover over the side rails 18 and 20. The flexed lid dome 64, with the dome side edges 32 and 34 still positioned within the side rail notches 58 and 62, is slid toward the end rail 14 until the dome arcuate edge 36 contacts the end section arcuate edge 24. As best shown in FIG. 3, the contact of the dome arcuate edge 36 with the end section arcuate edge 24 forms lid joint 66.

As shown in FIG. 5, the lid joint 66 has an inside seam 68. In the illustrated embodiment, the inside seam 68 of the lid joint 66 is sealed with an adhesive, such as for example a wood glue or caulk.

While the invention as been described with reference to particular embodiments, it should be understood that various changes may be made and equivalents may be substituted for elements thereof without departing from the essential scope of the invention. In addition, many modifications may be made to adapt a particular situation or material to the teachings of the invention without departing from the essential scope thereof. Therefore, it is intended that the invention not be limited to the particular embodiments, but that the invention shall include all embodiments falling within the scope of the claims.

We claim:

1. A casket lid assembly for a casket comprising:

an end rail including an end rail notch;

opposing side rails attached to the end rail, the side rails each including a side rail notch;

an end section positioned within the end rail notch; and a lid dome including a pair of dome side edges, the lid dome being flexible to form a flexed lid dome, the dome side edges positioned within the side rail notches and in contact with the end section, the lid dome and the end section forming a lid joint.

2. The casket lid assembly of claim 1, wherein the end rail notch has a substantially rectangular cross-sectional shape.

3. The casket lid assembly of claim 1, wherein the end rail notch extends the length of the end rail.

4. The casket lid assembly of claim 1, wherein the end rail notch has a width that corresponds to a thickness of the end section.

5. The casket lid assembly of claim 1, wherein each side rail notch has a substantially rectangular cross-sectional shape.

6. The casket lid assembly of claim 1, wherein each side rail notch extends the length of the side rail.

7. The casket lid assembly of claim 1, wherein each side rail notch has a width that corresponds to a thickness of the lid dome.

8. The casket lid assembly of claim 1, wherein the end section includes an arcuate edge.

9. The casket lid assembly of claim 8, wherein the arcuate edge is in contact with the lid dome.

10. The casket lid assembly of claim 1, wherein the end section is made of plywood.

11. The casket lid assembly of claim 1, wherein the end section has a thickness between 2.0-3.0 mm.

12. The casket lid assembly of claim 1, wherein the end rail notch is centered on an axis, the axis forms an angle with a top of each side rail, the angle being approximately 22.5°.

13. The casket lid assembly of claim 1, wherein the lid dome is made of plywood.

14. The casket lid assembly of claim 1, wherein the lid dome has a thickness between 2.0-3.0 mm.

15. The casket lid assembly of claim 1, wherein each side rail notch is centered on an axis, each axis forms an angle with a top of the end rail, each angle being approximately 22.5°.

16. The casket lid assembly of claim 1, wherein the lid dome includes an arcuate edge, the arcuate edge being in contact with the end section.

17. The casket lid assembly of claim 1, wherein the lid joint includes an inside seam.

18. The casket lid assembly of claim 17, wherein the inside seam is sealed.

<antocite_ref type="header_navigation">US 7,380,316 B1
5 6</antocite_ref>
* * * * *